United States Patent [19]

Hemenway

[11] Patent Number: 4,861,310

[45] Date of Patent: Aug. 29, 1989

[54] AMUSEMENT DEVICE

[76] Inventor: Patrick A. Hemenway, 4400 Ocean Beach Hwy. Space 8, Longview, Wash. 98632

[21] Appl. No.: 228,129

[22] Filed: Jul. 25, 1988

[51] Int. Cl.[4] ..... A63H 33/02

[52] U.S. Cl. ..... 446/453; 446/450

[58] Field of Search ..... 446/450, 451, 452, 453; 273/412, 126 R, 129 R, 129 K, 129 L

[56] References Cited

U.S. PATENT DOCUMENTS

| | | | |
|---|---|---|---|
| D. 170,677 | 10/1953 | Chrisco | 446/450 X |
| 2,381,581 | 8/1945 | Entringer | 446/450 |
| 2,577,189 | 12/1951 | Hammett | 273/129 |
| 2,976,645 | 3/1961 | Hight et al. | 446/450 |
| 3,078,620 | 2/1963 | Frye, Jr. et al. . | |
| 3,123,937 | 3/1964 | Pace . | |
| 3,788,000 | 1/1974 | Jenkins | 446/450 |
| 3,881,277 | 5/1975 | Delph et al. | 446/450 |
| 4,453,341 | 6/1984 | Klukos | 446/450 |

*Primary Examiner*—Robert A. Hafer
*Assistant Examiner*—Sam Rimell
*Attorney, Agent, or Firm*—James D. Givnan, Jr.

[57] ABSTRACT

The device includes a shaft provided with a handgrip at one end and a cross head of bent wire construction at its remaining end. Rails extend parallel to the shaft and are offset therefrom a suitable distance to enable the upright support of a ring to enable reception of the ring in an upright manner, retention of the ring and launching of the ring without hand contact with the ring. The rails each include a lower end segment inclined to the shaft axis to facilitate entry of the ring into a guideway provided by the shaft and the rails.

4 Claims, 1 Drawing Sheet

FIG. 1
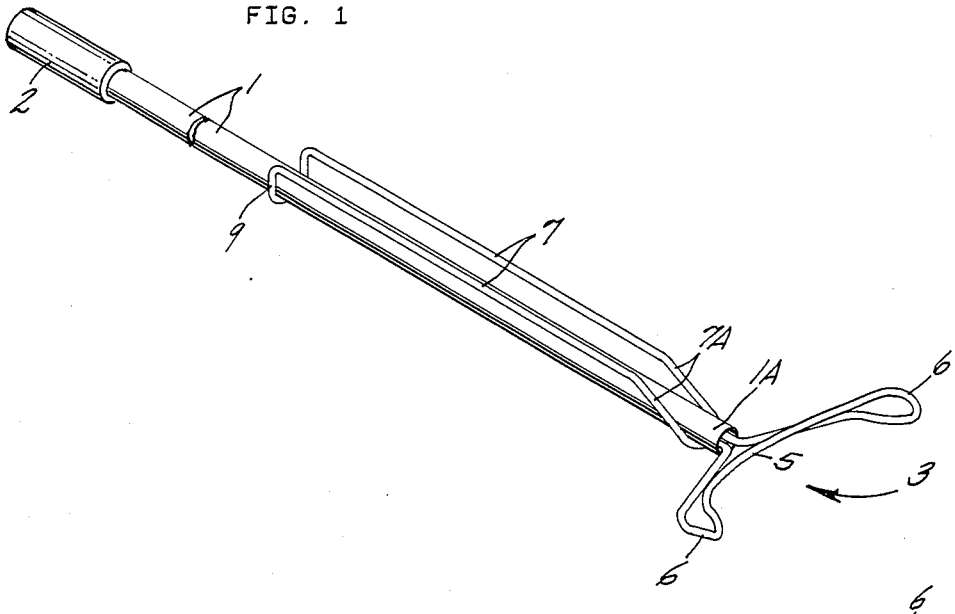
FIG. 2
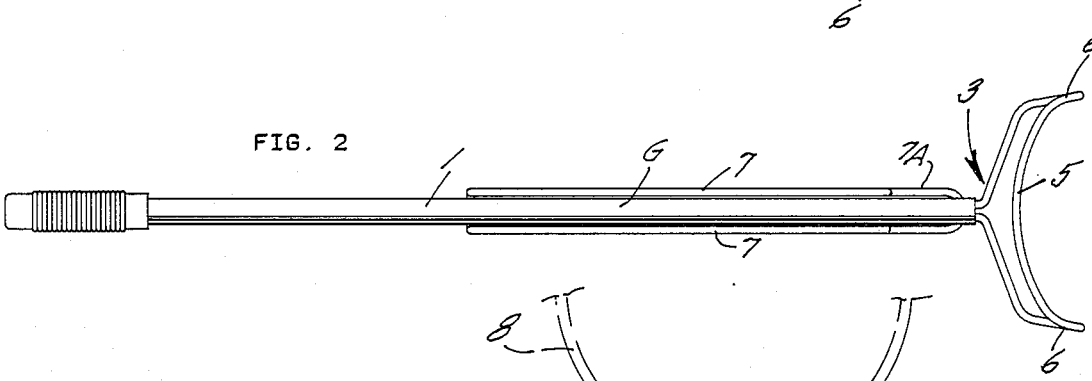
FIG.3
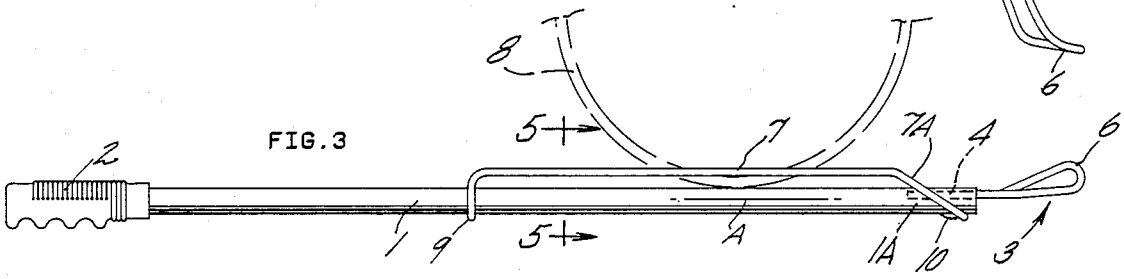
FIG.4
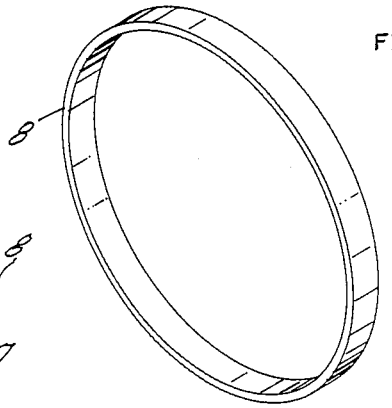
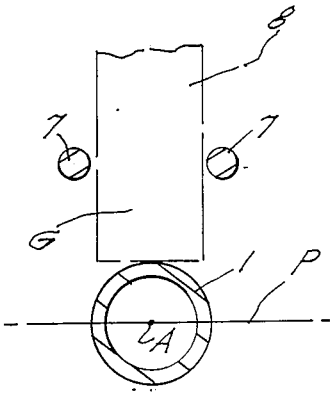
FIG.5

AMUSEMENT DEVICE

BACKGROUND OF THE INVENTION

The present device pertains generally to a device for arresting and launching a ring or the like.

In the prior art are numerous hand held devices for propelling a hoop or ring along a ground surface. Typically such devices include a cross head at their lowermost end with curved or angular surfaces for engagement with the article being propelled along the ground. Examples of such devices are found in U.S. Pat. Nos. 2,577,189; 3,078,620; 3,123,937; 4,453,341 and Design Patent 170,677.

Certain of the above patents namely, 3,078,620; 3,123,937 and Design Patent 170,677, disclose a device having an elongate, ring receiving channel for downward travel of a ring, hoop, et., for the purpose of launching the rolled article whereafter the article is propelled along the ground by the cross head of the device. Essentially the devices are directed toward being used singly by one individual in the general manner of the old hoop type toy. The devices are not intended to momentarily arrest the rolled article and thereafter launch same all without touching of the article in a competitive manner.

SUMMARY OF THE PRESENT INVENTION

The present invention is embodied within an amusement device having a guideway formed therealong for the momentary upright support of a circular article therein.

The device in one form includes a tubular shaft equipped at one end with a handle and, at its lowermost end, receives inserted end segments of a shaped wire cross head. A pair of parallel rails are offset from the shaft a distance adequate to receive and support a circular article in rolling contact with the shaft surface. Additionally, the rails terminate in an inclined or sloped manner, adjacent the lowermost end of said shaft, to minimize obstructing entry of the rolled article into the rail defined guideway above the shaft. The cross head of the device is shaped so as to avoid having edges which could result in injury to the child or other person using the device.

Important objectives of the present invention include the provision of an amusement device which may be used by two or more persons in a competitive manner with the rolled article passing between the competitors without the necessity of grasping the article; the provision of an amusement device having a guideway formed therealong by a pair of rails offset from the axis of a supporting shaft a distance adequate to retain the rolled article upright while stationary on the device; the provision of an amusement device having a cross head at its lower end for propelling a ring, hoop, etc., along a surface with cross head shape with curved extremities to avoid projections which could be injurious.

BRIEF DESCRIPTION OF THE DRAWINGS

In the accompanying drawings:

FIG. 1 is a perspective view of the present amusement device;

FIG. 2 is a plan view thereof;

FIG. 3 is a side elevational view thereof;

FIG. 4 is a perspective view of the circular article used with the present device; and FIG. 5 is a vertical sectional view taken along line 5—5 of FIG. 3.

DETAILED DESCRIPTION OF THE PREFERRED EMBODIMENTS

With continuing attention to the drawings wherein applied reference numerals indicate parts similarly hereinafter identified, the reference numeral 1 indicates an elongate member provided with a handgrip at 2 at it upper end.

An end segment 1A of member 1 receives inserted end segments 4 (FIG. 3) of a cross head generally at 3. Said cross head includes a bowed segment 5 terminating at its lateral extremities in curved segments 6. The cross head 3 is formed from a continuous length of wire and avoids sharp corners or projections which could be a source of injury. The end segments 4 are suitably secured within the end of member 1A as by deforming said end segment 1A for example. Obviously the cross head 3 may be otherwise affixed to elongate member 1.

Indicated at 7 are parallel rails which extend a foot or so along elongate member 1. The rails, along with the uppermost exterior surface of member 1, provide a guideway G for a ring at 8 shown in FIG. 4. As viewed in FIG. 5, the parallel rails are offset from a plane P which contains the axis A of the elongate member 1 as well as from the outer surface of said member. The rails may be advantageously shaped from stiff wire with a U-shaped segment 9 being welded to member 1 in an inconspicuous manner. Rail end segments at 7A are inclined to plane P and also are secured to said member in a suitable manner as by a weld 10. The inclined rail end segments 7A are less likely to divert ring 8 from entrance into the guideway of the device than rail end segments disposed normal to plane P.

In one suitable embodiment of the present device, tubular member 1 is manufactured from $\frac{5}{8}$ of an inch o.d. tubing while the wire rails are of 3/16 of an inch diameter. The rails are vertically offset from the uppermost surface of elongate member 1 approximately $\frac{5}{8}$ of an inch. With the ring 8 being $8\frac{1}{2}$ inches in diameter having a $\frac{3}{4}$ of an inch outer wall length, the ring may be supported as shown in FIG. 5 in upright disposition on member 1 without manual support.

In use, two or more players may "catch" the rolled article by aligning the device to receive the approaching article. Travel of the article 8 in the guideway is momentarily stopped by inclining the device to a steeper angle whereafter the device is aimed for launching the article toward the player selected. A degree of skill is necessary to position the device, both horizontally and vertically, to receive the rolled article, to stop same in the guideway and aim the device for launching the article in the direction desired.

The present amusement device permits competition between several users or contestants each located about the perimeter of a playing area. A degree of skill is required to utilize the present device in game competition where the ring is passed between players with each player arresting ring movement followed by launching of the ring toward another player. The rail feature of the present device permits lateral movement of the device with ring thereon which would not be feasible with the known prior art devices. The spacing between opposed rail surfaces, in one suitable embodiment of the device, is $\frac{7}{8}$ of an inch to provide minimum clearance with the edges of the ring as viewed in FIG. 5 resulting in the ring being retained upright between the rails without manual assistance.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. An amusement device for receiving and launching a rolled article, said device comprising, a shaft having a handgrip at one end, a cross head affixed to the remaining end of said shaft, and a pair of wire rails parallel to and laterally offset from said shaft, said pair of rails and said shaft defining a guideway for the rolled article for launching and retrieving same when the device is inclined, said rails merging with a U-shaped segment secured to said shaft.

2. The device claimed in claim 1 wherein said rails include end segments parallel to one another, said end segments inclined to a plane containing the longitudinal axis of said shaft to facilitate entrance of the rolled article into said guideway.

3. The device claimed in claim 1 wherein said cross head is of wire rod having a bowed segment for article contact.

4. The device claimed in claim 3 wherein said cross head includes curved extremities and parallel end segments the latter disposed within said remaining end of said shaft.

* * * * *